US006444332B1

(12) United States Patent
Bettridge

(10) Patent No.: US 6,444,332 B1
(45) Date of Patent: Sep. 3, 2002

(54) METALLIC ARTICLE HAVING A PROTECTIVE COATING AND A METHOD OF APPLYING A PROTECTIVE COATING TO A METALLIC ARTICLE

(75) Inventor: David Bettridge, Derby (GB)

(73) Assignee: Rolls-Royce plc, London (GB)

( * ) Notice: Subject to any disclaimer, the term of this patent is extended or adjusted under 35 U.S.C. 154(b) by 93 days.

(21) Appl. No.: 09/669,720

(22) Filed: Sep. 26, 2000

(30) Foreign Application Priority Data

Oct. 7, 1999 (EP) ..... 9923592

(51) Int. Cl.[7] ..... B32B 15/04; F03B 3/12

(52) U.S. Cl. ..... 428/630; 428/633; 428/666; 428/469; 428/472; 428/432; 428/701; 428/702; 416/241 R; 416/241 B

(58) Field of Search ..... 428/630, 631, 428/632, 633, 666, 469, 472, 432, 697, 699, 702, 701; 416/241 R, 241 B

(56) References Cited

U.S. PATENT DOCUMENTS 3,664,765 A * 5/1972 Ishimatsu et al.

6,071,622 A * 6/2000 Beesabathina et al.

FOREIGN PATENT DOCUMENTS

| | | | |
|---|---|---|---|
| EP | 0 108 030 | A | 5/1984 |
| JP | 59023872 | AB | 2/1984 |
| JP | 62198138 | AB | 9/1987 |
| JP | 63093877 | AB | 4/1988 |
| JP | 01219039 | AB | 9/1989 |
| JP | 05320931 | AB | 12/1993 |

* cited by examiner

*Primary Examiner*—Deborah Jones
*Assistant Examiner*—Jennifer McNeil
(74) *Attorney, Agent, or Firm*—W. Warren Taltavull; Manelli Denison & Selter PLLC

(57) ABSTRACT

A metallic turbine blade (10) has a protective coating (22) applied to the shank (16) and the root (18) of the turbine blade (10). The protective coating (22) comprises a chromized coating (24) diffused into the surface of the metallic article (10) and a glass coating (26) on the chromized coating (24). The glass coating (26) comprises a silicate glass, preferably having a chromium oxide filler. The glass coating (26) preferably comprises a boron titanate silicate glass having a chromium oxide filler. The protective coating (22) provides oxidation and sulphidation resistance for the shank (16) and root (18) of the turbine blade (10).

9 Claims, 1 Drawing Sheet

METALLIC ARTICLE HAVING A PROTECTIVE COATING AND A METHOD OF APPLYING A PROTECTIVE COATING TO A METALLIC ARTICLE

FIELD OF THE INVENTION

The present invention relates to a metallic article having a protective coating and a method of applying a protective coating to a metallic article. The present invention relates in particular to a nickel, a cobalt or an iron base superalloy article having a protective coating and a method of applying a protective coating to a nickel, a cobalt or an iron base superalloy article.

BACKGROUND OF THE INVENTION

Conventional environmental protective coatings for nickel base superalloys, cobalt base superalloys and iron base superalloys include aluminide coatings, platinum modified aluminide coatings or chromium modified aluminide coatings for high temperature oxidation and Type 1 sulphidation resistance.

Conventional environmental protective coatings for nickel base superalloys, cobalt base superalloys and iron base superalloys include silicide modified aluminide coatings or chromised coatings for lower temperature Type 2 and Type 3 sulphidation resistance.

Aluminide coatings are generally applied by the well-known pack aluminising, out of pack vapour aluminising or slurry aluminising processes. Platinum coatings are generally applied by electroplating, sputtering or physical vapour deposition processes. Chromium coatings are generally applied by pack chromising or out of pack vapour chromising. Silicide coatings are generally applied by slurry aluminising.

It has been found that the roots, shanks and internal cooling passages of the turbine blades are suffering sulphidation, particularly low chromium nickel base superalloy turbine blades. The roots, shanks and internal cooling passages of the turbine blades may suffer from Type 2 and Type 3 sulphidation, this is a particular problem at low temperatures, below about 850° C. The sulphidation may lead to stress cracking of the aerofoils and/or roots of the turbine blades.

In the case of turbine blades, or turbine vanes, for gas turbine engines it is known to provide more than one environmental coating if more than one type of oxidation or sulphidation is experienced. For example platinum aluminide coatings may be provided on the aerofoils of the turbine blades and chromised coatings may be provided on the shanks, roots and internal cooling passages of the turbine blades to provide environmental protection.

However, it has been found that for some metallic articles, that once the chromised coating has been penetrated by the sulphidation, the sulphidation of the underlying metallic article occurs at a greater rate than a metallic article without a chromised coating.

SUMMARY OF THE INVENTION

Accordingly the present invention seeks to provide a novel protective coating for a metallic article and a novel method of applying a protective coating to a metallic article which reduces, preferably overcomes, the above mentioned problem.

Accordingly the present invention provides a metallic article having a protective coating on the metallic article, the protective coating comprising a chromised coating on the metallic article and a glass coating on the chromised coating.

Preferably the glass coating comprises a silicate glass.

Preferably the glass coating is a silicate glass having a chromium oxide filler.

Preferably the metallic article comprises a nickel base superalloy, a cobalt base superalloy or an iron base superalloy.

Preferably the glass coating comprises a boron titanate silicate glass having a chromium oxide filler.

Preferably the metallic article comprises a turbine blade or a turbine vane.

Preferably the thickness of the chromised coating is 10 μm to 30 μm.

Preferably the chromised coating has an outer region, the outer region of the chromised coating comprises 20–30 wt % chromium.

Preferably the thickness of the glass coating is 5 μm to 50 μm.

The present invention also provides a method of applying a protective coating to a metallic article comprising chromising the metallic article and depositing a glass coating on the chromised metallic article.

Preferably the method comprises depositing a silicate glass on the chromised metallic article.

Preferably the method comprises depositing a silicate glass having a chromium oxide filler on the chromised metallic article.

Preferably the metallic article comprises a nickel base superalloy, a cobalt base superalloy or an iron base superalloy.

Preferably the method comprises depositing a boron titanate silicate glass having a chromium oxide filler on the chromised metallic article.

Preferably the metallic article comprises a turbine blade or a turbine vane.

Preferably the method comprises depositing the boron titanate glass and chromium oxide filler by spraying with a binder.

Preferably the method comprises drying the glass coating, heating the glass coating at 100° C. for 1 hour and heating the glass coating at 1030° C. for 10 to 20 minutes to fuse the glass coating. Preferably the thickness of the glass coating is 10 μm to 50 μm.

Alternatively the method comprises depositing the silicate glass by sol gel processing. Preferably the thickness of the glass coating is 5 μm to 10 μm.

Preferably the method comprises chromising the metallic article by pack chromising, out of pack vapour chromising, chemical vapour deposition, slurry chromising or physical vapour deposition.

Preferably the method comprises out of pack vapour chromising at a temperature of 1050° C. to 1100° C. for 1 to 6 hours.

Preferably the thickness of the chromised coating is 10 μm to 30 μm.

Preferably the chromised coating has an outer region, the outer region of the chromised coating comprises 20–30 wt % chromium.

BRIEF DESCRIPTION OF THE DRAWINGS

The present invention will be more fully described by way of example with reference to the accompanying drawings in which.

DETAILED DESCRIPTION OF THE INVENTION

Figure 1:
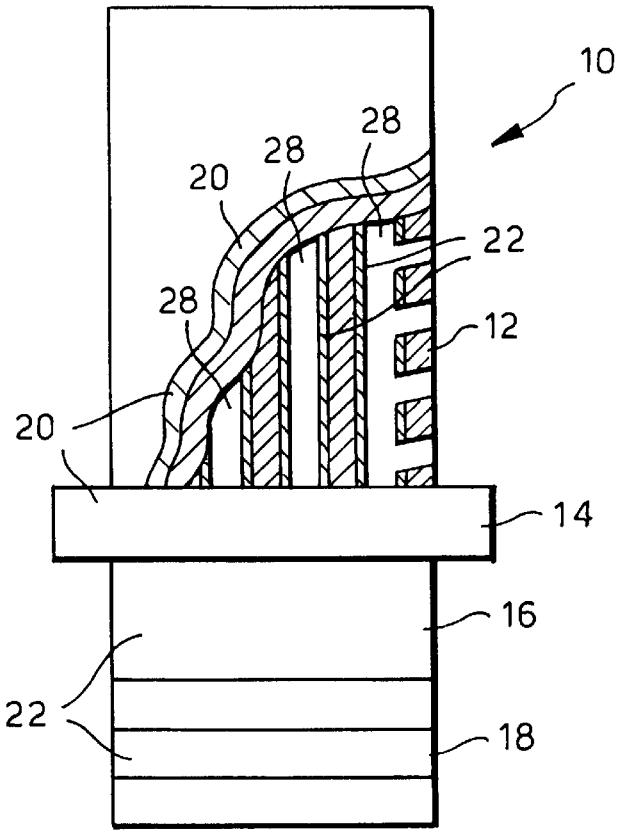
FIG. 1 shows a metallic turbine blade having a protective coating according to the present invention.

A gas turbine engine turbine blade 10, as shown in FIG. 1, comprises an aerofoil 12, a platform 14, a shank 16 and a root 18. The turbine blade 10 comprises a metal, preferably a nickel base superalloy, a cobalt base superalloy or an iron base superalloy. The turbine blade 10 has internal cooling air passages 28. The aerofoil 12 and the platform 14 of the turbine blade 10 have a protective coating 20 of platinum aluminide. The platinum aluminide coating 20 is preferably applied to all of the aerofoil 12 and that surface of the platform 14 which contacts the gas flowing through the turbine. The shank 16 and root 18 have a protective coating 22 according to the present invention. Alternatively the protective coating 22 may be applied to any regions of the turbine blade 10 which suffer from sulphidation, for example the internal cooling passages 28 of the turbine blade 10.

Figure 2:
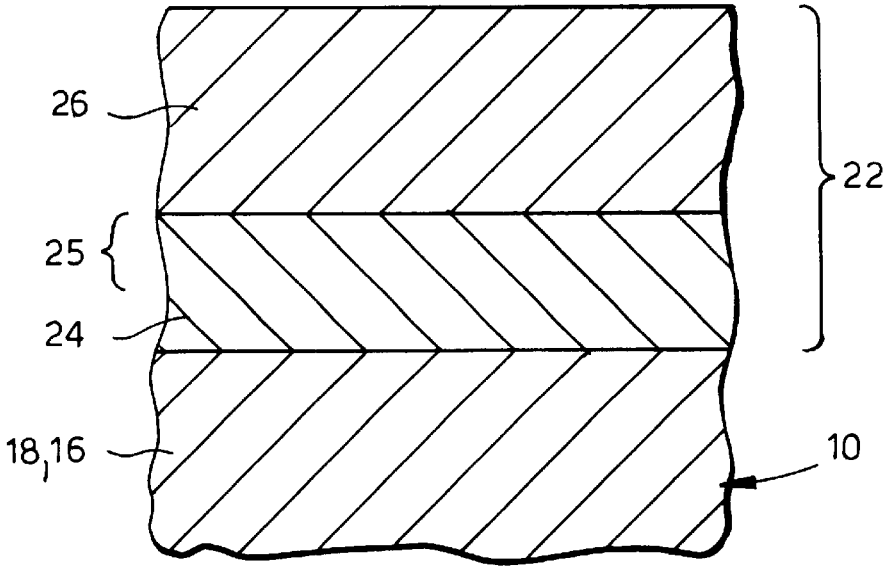
FIG. 2 is a cross-sectional view through the metallic turbine blade and protective coating according to the present invention.

The metallic turbine blade 10 and protective coating 22 are shown more clearly in FIG. 2.

The protective coating 22 comprises a chromised coating 24 diffused into/on the surfaces of the shank 16, root 18 and internal cooling passages 28 of the metallic turbine blade 10. A glass coating 26, preferably a silicate glass having a chromium oxide filler, is arranged on the chromised coating 24. The glass coating 26 preferably comprise a boron titanate silicate glass having a chromium oxide filler.

The silicate glass and chromium oxide filler are dispersed in a binder and distilled water. Preferably a silicate glass and chromium oxide filler frit, sold under the trade name E3765 by Cookson Matthey, Ceramics and Minerals Division of Meir, Stoke-on Trent, United Kingdom, is dispersed in a poly vinyl acetate (PVA) binder, sold under the trade name J246, and distilled water. Preferably the mixture is 632 parts by weight silicate glass and chromium oxide filler, 160 parts by weight poly vinyl acetate binder and 600 parts by weight distilled water.

The metallic turbine blades 10 are initially prepared by abrasive blasting of the surfaces to be coated by 120–220 British Standard mesh alumina grit.

The chromised coating 24 is deposited onto the external and internal surfaces, for example the shank 16, the root 18 and the internal cooling passages 28, of the metallic turbine blade 10 to be coated. The chromised coating 24 is deposited by pack chromising, out of pack vapour chromising, chemical vapour deposition, slurry chromising, physical vapour deposition or any other suitable process. For example the chromised coating is produced by out of pack vapour chromising at a temperature of 1050° C. to 1100° C. for 1 to 6 hours.

The chromised surfaces of the turbine blade 10 are prepared by abrasive blasting by 120–220 British Standard mesh alumina grit. Surfaces not requiring the glass coating are masked.

The glass coating 26 is deposited onto the chromised coating 24 on the external surfaces, the shank 16 and root 18, of the turbine blade 10 using conventional paint spraying equipment and the mixture of glass, binder and water mentioned above. A minimum of two glass coatings 26 are deposited onto the chromised coating 24.

The masks are removed and the glass coating 26 is then dried in air, heated up to a temperature of 100° C. and maintained at 100° C. for 1 hour. The glass coating 26 is then heated up to a temperature of 1030° C. and maintained at that temperature for 10 to 20 minutes to fuse the glass coating 26.

Alternatively the glass coating 26 is deposited onto the chromised coating 24 on the external surfaces and internal surfaces, the shank 16, root 18 and internal cooling air passages 28, of the turbine blade 10 using sol gel processing. The sol gel process is particularly useful because it enables the glass coating 26 to be deposited on the surfaces of the internal cooling air passages 28.

Finally the turbine blade 10 is age heat treated at the appropriate temperature for the appropriate time. The chromised coating 24 is preferably 10 $\mu$m to 30 $\mu$m in thickness and the chromised coating 24 has an outer region 25, preferably the outer region 25 of the chromised coating 24 comprises 20–30 wt % chromium. The glass coating 26 is preferably 5 $\mu$m to 50 $\mu$m in thickness. For example in the case of a glass coating 26 deposited by conventional paint spraying the glass coating is 10 $\mu$m to 50 $\mu$m thick and in the case of a glass coating 26 deposited by sol gel processing the glass coating 26 is 5 $\mu$m to 10 $\mu$m thick.

The protective coating 22 provides protection against low temperature sulphidation at temperatures up to 850° C., particularly at temperatures around 750° C. The protective coating 22 provides two coatings, the chromised coating 24 and the glass coating 26 which form a barrier against sulphate contamination. The chromised coating 24 and the glass coating 26 have high concentrations of silica and chromium oxide, which are powerful inhibitors of the sulphidation mechanisms.

The glass coating 26 protects the chromised coating 24 and the turbine blade 10 against sulphidation. The chromised coating 24 protects the turbine blade 10 in the event that the glass coating 26 is penetrated by the sulphidation. The chromised coating 24 also protects the turbine blade 10 at regions where the bonding of the glass coating 26 to the chromised coating 24 is poor, for example at edges of the shank 16 and root 18.

The protective coating system of the present invention provides very effective protection for the metallic article and has the advantage of being relatively cheap and easy to apply.

Although the invention has been described with reference to a turbine blade, it is equally applicable to turbine vanes and any other gas turbine engine components, which may suffer from sulphidation, e.g. turbine sealing segments.

Although the invention has been described with reference to a glass coating comprising boron titanate silicate glass containing a chromium oxide filler, it is equally applicable to use other silicate glass coatings, with or without a chromium oxide filler, and other suitable glass coatings.

I claim:

1. A metallic article having a protective coating on the metallic article, the protective coating comprising a chromised coating on the metallic article and a glass coating on the chromised coating, the glass coating comprising a silicate glass having a chromium oxide filler.

2. A metallic article as claimed in claim 1, wherein the glass coating comprises a boron titanate silicate glass having a chromium oxide filler.

3. A metallic article as claimed in claim 1 wherein the metallic article comprises a nickel base superalloy, a cobalt base superalloy or an iron base superalloy.

4. A metallic article as claimed in claim 1 wherein the metallic article comprises a turbine blade or a turbine vane.

5. A metallic article as claimed in claim 1 wherein the thickness of the chromised coating 10 $\mu$m to 30 $\mu$m.

6. A metallic article as claimed in claim 5 wherein the chromised coating has an outer region, the outer region of the chromised coating comprises 20–30 wt % chromium.

7. A metallic article as claimed in claim 1 wherein the thickness of the glass coating is 5 $\mu$m to 50 $\mu$m.

8. A metallic article having a protective coating on the metallic article, the metallic article comprising a turbine blade, the turbine blade having a root, a shank, a platform and an aerofoil, the aerofoil having internal cooling passages and an external surface, a first protective coating on at least one of the root, the shank and the internal cooling passages of the aerofoil, a second protective coating, different from said first protective coating, on at least one of the platform and the external surface of the aerofoil, the first protective coating comprising a chromium coating diffused into the metallic article and a glass coating on the chromium coating, the glass coating comprising a silicate glass having a chromium oxide filler.

9. A metallic article as claimed in claim 8 wherein the second different protective coating comprises a platinum aluminide coating.

* * * * *